US010001032B2

(12) United States Patent
Takata et al.

(10) Patent No.: US 10,001,032 B2
(45) Date of Patent: Jun. 19, 2018

(54) WATER REMOVAL DEVICE FOR STEAM TURBINE

(71) Applicant: MITSUBISHI HITACHI POWER SYSTEMS, LTD., Kanagawa (JP)

(72) Inventors: Ryo Takata, Tokyo (JP); Soichiro Tabata, Tokyo (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 335 days.

(21) Appl. No.: 14/903,371

(22) PCT Filed: May 12, 2014

(86) PCT No.: PCT/JP2014/062568
§ 371 (c)(1),
(2) Date: Jan. 7, 2016

(87) PCT Pub. No.: WO2015/015858
PCT Pub. Date: Feb. 5, 2015

(65) Prior Publication Data

US 2016/0146057 A1 May 26, 2016

(30) Foreign Application Priority Data

Jul. 30, 2013 (JP) ..... 2013-158312

(51) Int. Cl.
*F01D 25/32* (2006.01)
*F01D 9/04* (2006.01)

(52) U.S. Cl.
CPC ..... *F01D 25/32* (2013.01); *F01D 9/041* (2013.01); *F05D 2220/31* (2013.01);
(Continued)

(58) Field of Classification Search
CPC . F01D 25/32; F01D 9/02; F01D 9/041; F01D 5/18; F01D 5/145; F05D 2240/123
(Continued)

(56) References Cited

U.S. PATENT DOCUMENTS 6,474,942 B2 11/2002 Markytan
2011/0135447 A1 6/2011 Guo et al.

FOREIGN PATENT DOCUMENTS

CN 101769175 7/2010
JP 49-9522 3/1974
(Continued)

OTHER PUBLICATIONS

International Search Report dated Jun. 10, 2014 in International (PCT) Application No. PCT/JP2014/062568 with English translation.

(Continued)

*Primary Examiner* — Ninh H Nguyen
*Assistant Examiner* — Topaz L Elliott
(74) *Attorney, Agent, or Firm* — Wenderoth, Lind & Ponack, L.L.P.

(57) ABSTRACT

A hollow portion is formed inside a stator blade. A slit having an inlet opening on a pressure surface of the stator blade facing wet steam flow is formed that communicates with the hollow portion in the axial direction of the stator blade. The hollow portion communicates with a region having a lower pressure than the flow field of the wet steam flow. The pressure in the hollow portion is reduced to introduce water film flow formed from water drops on the pressure surface of the stator blade to the slit. The slit is formed at a downstream side end, in the flow direction of the wet steam flow, of the hollow portion, and the stator blade
(Continued)

trailing edge side wall surface of the slit is at an acute angle to a leading edge side reference plane of the pressure side of the stator blade.

5 Claims, 10 Drawing Sheets

(52) U.S. Cl.
CPC .. *F05D 2240/123* (2013.01); *F05D 2250/182* (2013.01); *F05D 2250/294* (2013.01); *F05D 2250/312* (2013.01); *F05D 2250/314* (2013.01)

(58) Field of Classification Search
USPC ... 416/169.1, 169.2, 169.3, 90 R, 91, 231 R; 415/115
See application file for complete search history.

(56) References Cited

FOREIGN PATENT DOCUMENTS

| | | | |
|---|---|---|---|
| JP | 63-117104 | | 5/1988 |
| JP | 63272902 | A * | 11/1988 |
| JP | 64-080705 | | 3/1989 |
| JP | 3-47403 | | 2/1991 |
| JP | 04140401 | A * | 5/1992 |
| JP | 09-025803 | | 1/1997 |
| JP | 2011-117451 | | 6/2011 |
| JP | 2012-137094 | | 7/2012 |

OTHER PUBLICATIONS

International Preliminary Report on Patentability and Written Opinion of the International Searching Authority dtaed Jun. 10, 2014 in International (PCT) Application No. PCT/JP2014/062568 with English translation.
Decision to Grant a Patent dated Jul. 29, 2016 in corresponding Japanese Application No. 2015-529412, with English translation.
Extended European Search Report dated Jul. 6, 2016 in corresponding European Application No. 14832113.6.
Extended European Search Report dated Jun. 24, 2016 in corresponding European Application No. 14832891.7.
Office Action dated May 25, 2016 in corresponding Chinese Application No. 201480034085.3, with English translation.

* cited by examiner

ENLARGED VIEW OF PORTION X

ENLARGED VIEW OF PORTION Y

WATER REMOVAL DEVICE FOR STEAM TURBINE

TECHNICAL FIELD

The present disclosure relates to a water removal device for a steam turbine capable of removing water drops or water films on a pressure surface of a stator blade of the steam turbine

BACKGROUND

Steam flow in a steam turbine has a wetness of at least 8% near the last stage turbine. The steam flow generates water drops, and the wet steam flow may lead to a moisture loss, and the turbine efficiency may be reduced. In addition, the water drops generated from the wet steam flow may collide with a rotor blade rotating at a high speed, which may lead to erosion. The water drops contained in the wet steam flow may attach on a surface of a stator blade to from a water film. The water film may form a water film flow on the surface of the stator blade. The water film flow may flow to the trailing edge side of the stator blade, and then it may break into coarse water drops at the trailing edge of the stator blade. The coarse water drops may be one of the greatest reasons that cause erosion of the rotor blade.

FIG. 14 is a diagram illustrating a flow field of a steam flow of a steam turbine. A stator blade 100 is disposed between and connected to a diaphragm 104 provided on a rotor shaft (not shown) side and a support ring 106 provided on a tip side. Small water drops dw contained in a wet steam flow s attach onto a surface of the stator blade 100, particularly onto a pressure surface fs of the stator blade, which faces to more amount of wet steam flow s than a suction surface bs of the stator blade, and the water drops collect on the pressure surface fs of the stator blade to form a water film flow sw moving toward the trailing edge side of the stator blade. The water film flow sw on the pressure surface of the stator blade flows from the leading edge fe side of the stator blade to the trailing edge re side of the stator blade, and it breaks into coarse water drops cw at the trailing edge re of the stator blade. The coarse water drops cw collide with a rotor blade on a downstream side to erode a surface of the rotor blade.

FIG. 15 is a diagram illustrating a velocity triangle of a wet steam flow s at the outlet of the stator blade. An absolute velocity Vcw of a coarse water drop cw is smaller than an absolute velocity Vs of the wet steam flow s on the outlet side of the stator blade. Accordingly, in the relative velocity field considering the circumferential velocity U of the rotor blade 102, the coarse water drop cw has a relative velocity Wcw which is larger than the relative velocity Ws of the wet steam flow s and has a smaller incident angle, and it collides with a surface of the rotor blade 102 at a high speed. Thus, the rotor blade 102 is susceptible to erosion by the coarse water drops cw, particularly near the tip of the blade where the circumferential velocity is relatively large. Further, the collision of the coarse water drops cw may lead to increase in breaking loss of the rotor blade 102.

In view of this, in order to remove water drops on a surface of a rotor blade, such a method is conventionally employed that a slit opening to a surface of a stator blade is formed to introduce the water drops on the surface of the stator blade from the slit, thereby to remove the water drops from the flow field of the steam flow. Patent Document 1 and Patent Document 2 each discloses a structure of a stator blade having such a slit formed.

FIG. 16 to FIG. 19 are diagrams of an example of a stator blade having such a slit formed. In FIG. 16 and FIG. 17, the both ends in the axial direction of the stator blade 100 are disposed between and connected to a diaphragm 104 which has a separated body from a rotor shaft 108 and which is provided on the rotor shaft 108 side, and a support ring 106 on a tip side. The rotor blade 102 is integrally formed with the rotor shaft 108 via a disk rotor 110. Plurality of slits 112 and plurality of slits 114, extending along the height direction of the stator blade 100, are formed on the pressure surface fs and the suction surface bs of the stator blade, respectively. Inside the support ring 106, a hollow portion 106*a* is formed. The hollow portion 106*a* and a slit groove 116 formed at a back end of the support ring 106 are in communication with a low pressure region. The low pressure region has a relatively low pressure than the flow field of the steam flow such that the water film flow sw can be drawn through the slits 112 and slits 114 and discharged to the hollow portion 106*a*.

FIG. 18 is a diagram of the conventional example where a slit is formed on the pressure surface of the stator blade. As shown in FIG. 18, a hollow portion 100*a* is formed inside the stator blade 100. The hollow portion 100*a* is in communication with the hollow portion 106*a* via a hole 106*b* formed in the support ring 106. The hollow portion 100*a* is in communication with the low pressure region via a hole 106*c*. The water film flow sw on the surface of the stator blade and flowing toward the trailing edge is drawn through the slits 112 into the hollow portion 100*a*.

The water film flow sw formed on the pressure surface fs of the stator blade collects water drops and the collection amount of the water drops becomes larger as the water film flow moves from the leading edge fe of the stator blade to the trailing edge re of the stator blade. In order to increase the water removal amount taking this into consideration, the slits 112 opening to the pressure surface fs of the stator blade are formed at the most trailing edge side of the stator blade in such a range that communication between the slits 112 and the hollow portion 100*a* is possible.

Further, as shown in FIG. 19, the stator blade trailing edge side wall surface 112*a* and the stator blade leading edge side wall surface 112*b* of the slit 112, which is formed on the pressure surface fs of the stator blade according to the conventional technique, are formed so as to make an inclination angle A of an obtuse angle (i.e. 90°<A) with the leading edge side reference plane of the pressure surface fs of the stator blade, as disclosed in Patent Document 1. The width of the inlet opening a of the slit 112 is thereby larger than the slit width b of the slit 112, and by permitting the slit 112 to face the flow direction of the wet steam flow s, the wet steam flow s becomes likely to move into the slit. That is, it is intended to actively draw the wet steam flow s into the slit 112, and to draw the water film flow sw along with the wet steam flow s into the slit 112.

CITATION LIST

Patent Literature

Patent Document 1: JP 1164-080705 A
Patent Document 2: JP 1109-025803 A

SUMMARY

Technical Problem

There is a limit for the arrangement of the hollow portion 100*a* on the trailing edge side of the stator blade due to the space inside the stator blade. If the inclination angle A of the slit 112 opening to the pressure surface fs of the stator blade is made obtuse, it is necessary to make the inlet opening a of the slit 112 closer to the leading edge side of the stator blade. If the inlet opening a is made close to the leading edge side of the stator blade, there may be a problem such that a water film flow sw formed on a site closer to the trailing edge side of the stator blade than the inlet opening a may not be removed and the water removal efficiency may be reduced.

Further, there may be a problem such that leakage loss may increase as the amount of steam flowing out of the slit 112 along with water films sw, and the turbine efficiency may be reduced.

The present invention has been made in view of such problem, and at least one embodiment of the present invention is to improve removal efficiency of a water film flow formed on a pressure surface of a stator blade by means of a simple processing of the stator blade, thereby to suppress erosion of a rotor blade.

Solution to Problem

In order to solve the above problem, the water removal device for a steam turbine according to at least an embodiment of the present invention comprises: a water removal flow passage formed inside the stator blade; and a slit extending in a direction intersecting with a steam flow, opening to the pressure surface of the stator blade and being communicated with a trailing edge side end portion of the water removal flow passage. The slit has a stator blade trailing edge side wall surface being at an acute angle to a leading edge side reference plane of the pressure surface of the stator blade.

In this specification, the wording "a leading edge side reference plane of the pressure surface of the stator blade" is used when it is intended to specify an inclination angle of a wall surface constituting the slit to the pressure surface of the stator blade where a part of the pressure surface of the stator blade which part is closer to the leading edge of the stator blade than the wall surface is the reference plane.

According to the above embodiment, the water removal device is configured so that the stator blade trailing edge side wall surface of the slit formed on the pressure surface of the stator blade is at an acute angle to the leading edge side reference plane of the pressure surface of the stator blade, whereby it is possible to make the inlet opening of the slit closer to the trailing edge of the stator blade as compared with the conventional techniques. It is thereby possible to dispose the inlet opening of the slit at a place where the water drop collection rate. Therefore, it is possible to remove a water film flow on the pressure surface at a place where the water film flow collection rate, thereby to improve the water removal efficiency.

In some embodiments, the slit has a stator blade leading edge side wall surface being at an acute angle to the leading edge side reference plane of the pressure surface of the stator blade. With this configuration, it is possible to permit the steam flow to separate at the upper end of the stator blade leading edge side wall surface of the slit, and due to the separation, the steam flow may become less likely to flow into the slit due to the separation, and a part of the separated steam flow may become a turbulence flow to form a vortex at the inlet opening of the slit.

Further, since each of the stator blade leading edge side wall surface and the stator blade trailing edge side wall surface of the slit is at an acute angle to the leading edge side reference plane of the pressure surface, the inlet opening of the slit is relatively narrow. The water removal flow passage formed inside the stator blade has a reduced pressure relative to the steam flow.

The water film flow on the pressure surface of the stator blade becomes more likely to flow into the slit because of the separation of the steam flow at the upper end of the stator blade leading edge side wall surface of the slit. Further, since the flow path of the water film flow turns to the slit at a large degree of at least 90° at the upper end of the stator blade leading edge side wall surface, the water film flow becomes more likely to be separated from the steam flow.

Further, since the inlet opening of the slit may be closed by the vortex generated, a pressure difference may be likely to arise between the flow field of the steam flow, whereby it is possible to efficiently separate the water film flow from the steam flow. Accordingly, it is possible to improve the water removal efficiency and to reduce the inflow amount of the steam flow into the slit, thereby to reduce the leakage loss of the steam flow and to suppress reduction in the turbine efficiency.

In some embodiments, the slit has a stator blade leading edge side wall surface being at an obtuse angle to the leading edge side reference plane of the pressure surface of the stator blade. With this configuration, a cross section of the slit has an inverted trapezoid like shape having a wide inlet opening. As the forming process of the shape, by employing electric discharging machining using an electrode having an inverted trapezoid like shape, the slit may be formed in one processing step. Accordingly, it is possible to reduce efforts for the processing, thereby to reduce cost for the processing. Further, since the slit has the outlet opening having a small diameter, it is possible to effectively suppress leakage of the steam flow.

In some embodiments, the slit has a stator blade leading edge side wall surface having an inlet side region being at an obtuse angle to the leading edge side reference plane of the pressure surface of the stator blade and having an outlet side region being at an acute angle to the leading edge side reference plane of the pressure surface of the stator blade.

With the above configuration, since the slit has a wide inlet opening, it is possible to promote the water film flow on the pressure surface of the stator blade to flow into the inlet opening of the slit.

In some embodiments, the slit has a stator blade leading edge side wall surface being at an acute angle to the leading edge side reference plane of the pressure surface of the stator blade, and the stator blade leading edge side wall surface of the slit has a stepped surface formed in an inlet side region and having a stepped portion having a different level from the pressure surface of the stator blade.

With the above configuration, although the closing effect at the inlet opening by the wet steam flow may be reduced, by introducing the water film flow on the pressure surface of the stator blade to the stepped surface, suppressing the inflow of the steam flow without increasing the width of the slit, it is possible to effectively separate water from the steam flow, and it is thereby possible to improve water removal effect.

In some embodiments, in addition to the above configuration, a wall surface continuous to the pressure surface of the stator blade and to the stepped surface is provided so as to be at an acute angle to the leading edge side reference plane of the pressure surface of the stator blade. With this configuration, since the flow path of the water film flow may turn to the slit at a large degree at the upper end of the stator blade leading edge side wall surface, it is possible to provide further improved separation effect between the wet steam flow and the water film flow.

Alternatively, in some embodiments, in addition to the above configuration, a wall surface continuous to the pressure surface of the stator blade and to the stepped surface is provided so as to be at an obtuse angle to the leading edge side reference plane of the pressure surface of the stator blade. With this configuration, the water film flow may be introduced to the stepped surface more easily, and the wall surface continuous to the stator blade leading edge side wall surface and to the stepped surface may be formed more easily.

Alternatively, in some embodiments, in addition to the above configuration, a wall surface continuous to the pressure surface of the stator blade and to the stepped surface includes a convex curved surface. With this configuration, the water film flow on the pressure surface of the stator blade may be introduced gradually to the stepped surface, whereby it is possible to separate the water film flow from the wet steam flow without making turbulent the wet steam flow around the inlet opening of the slit.

Advantageous Effects

According to at least an embodiment of the present invention, it is possible to improve the removal efficiency on the pressure surface of the stator blade by means of a simple processing of the stator blade such that the stator blade trailing edge side wall surface of the slit is formed so as to be at an acute angle to the leading edge side reference plane of the pressure surface of the stator blade, thereby to suppress erosion of a rotor blade and to improve the life of the rotor blade.

DETAILED DESCRIPTION

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not limitative of the scope of the present invention.

(First Embodiment)

Figure 1:
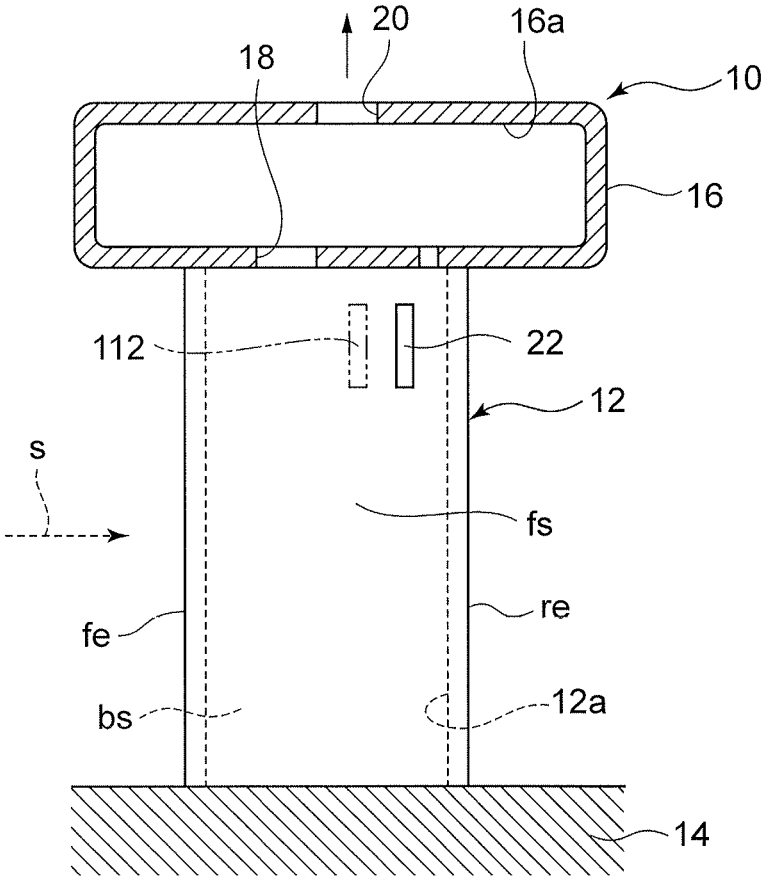
FIG. 1 is a front view of a water removal device according to a first embodiment of the present invention.

Now, a water removal device according to a first embodiment of the present invention will be described with reference to FIG. 1 to FIG. 4. In FIG. 1, a stator blade 12 is provided in a flow path of a wet steam flow of a steam turbine. The hub portion of the stator blade 12 is connected to a diaphragm 14, and the tip portion of the stator blade 12 is connected to a support ring 16.

Figure 2:
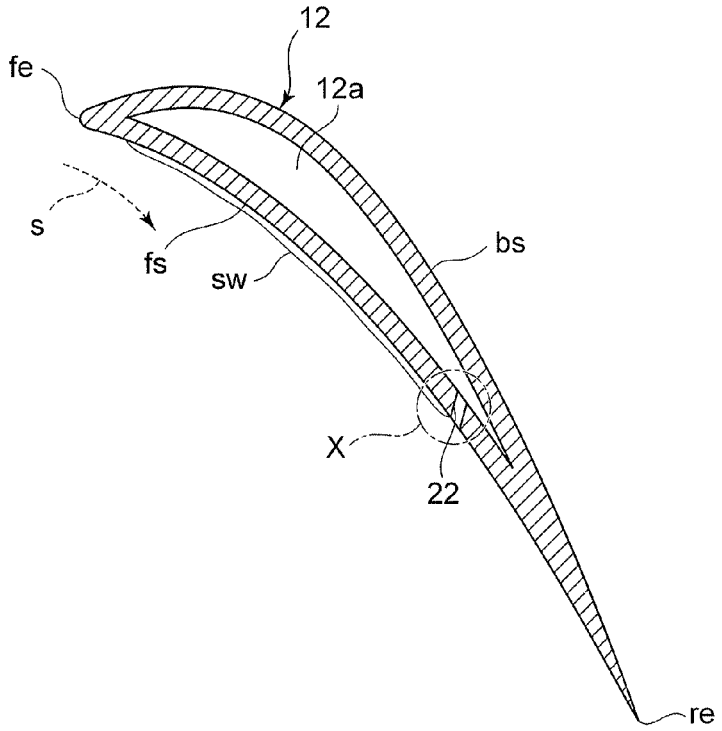
FIG. 2 is a transverse sectional view of a stator blade according to the first embodiment.
Figure 15:
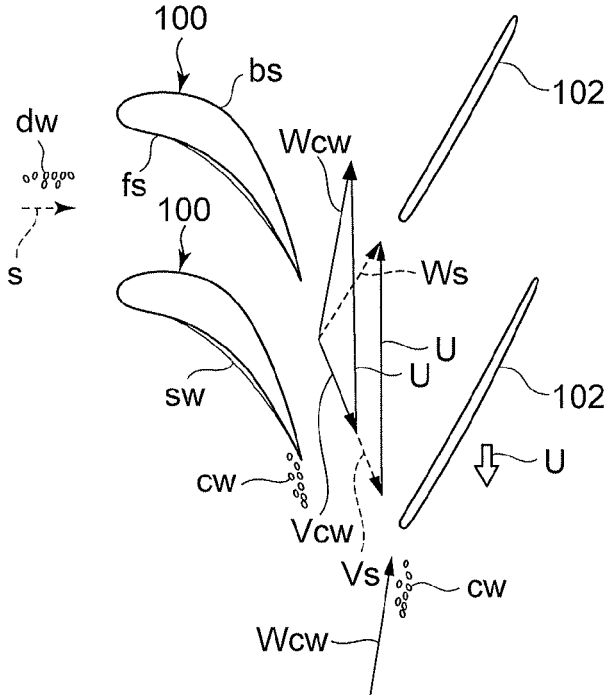
FIG. 15 is a chart showing a velocity triangle of a wet steam flow on a downstream side of the stator blade.
Figure 16:
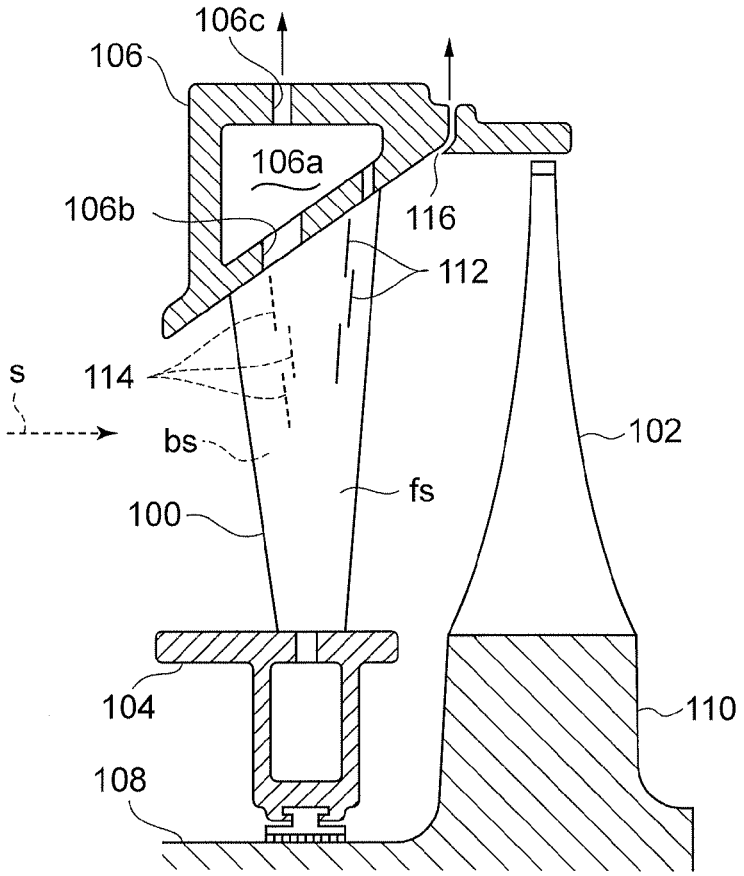
FIG. 16 is a cross sectional view of a conventional water removal device.
Figure 17:
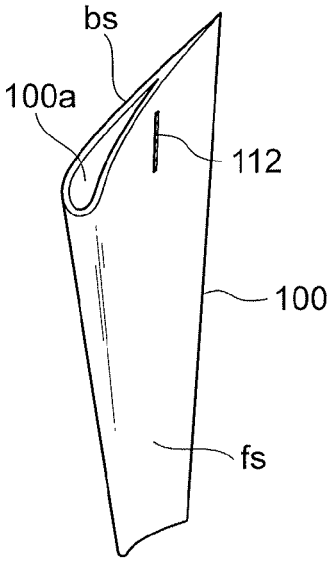
FIG. 17 is a perspective view of a conventional stator blade having a slit.
Figure 18:
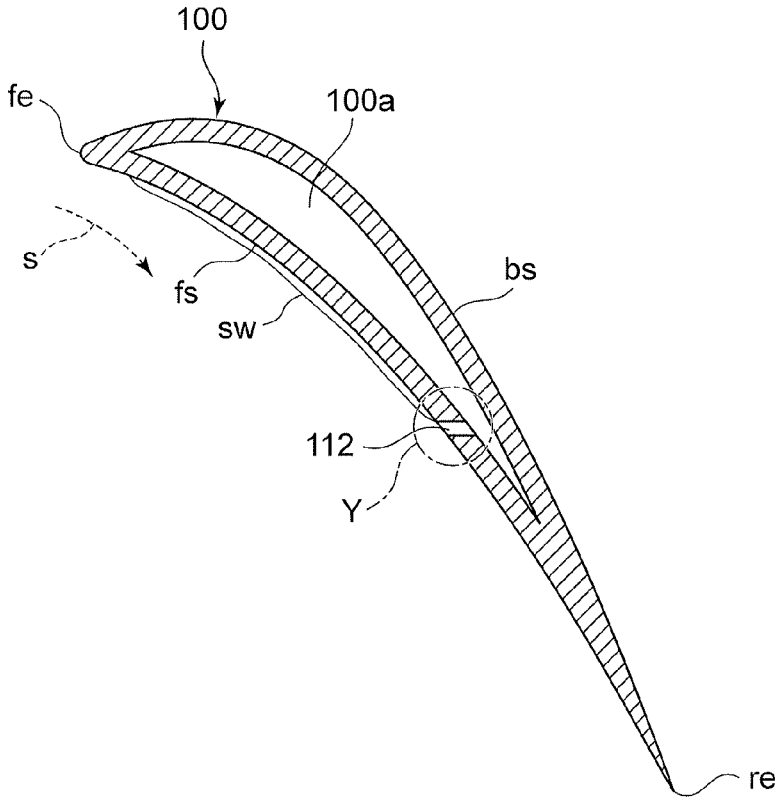
FIG. 18 is a transverse sectional view of a conventional stator blade having a slit.

In FIG. 2, as is the case with the stator blade 100 shown in FIG. 15, the leading edge fe of the stator blade is disposed on an upstream side, and the trailing edge re of the stator blade is disposed on a downstream side, of the flow direction of the wet steam flow s. Further, the stator blade is disposed to be inclined to the wet steam flow s so that the pressure surface fs of the stator blade faces to the wet steam flow s. Water contained in the wet steam flow s forms water drops, and the water drops attach on the pressure surface fs and the suction surface bs of the stator blade.

In the water removal device 10, a hollow portion 12*a* is formed inside the stator blade 12, and a hollow portion 16*a* is formed inside the support ring 16. The hollow portion 12*a* and the hollow portion 16*a* are communicated to each other via a hole 18 formed in a support ring 16. The hollow portion 16*a* has formed a hole 20 which is in communication with a region having a lower pressure than the flow field of the wet steam flow s, and each of the hollow portion 12*a* and the hollow portion 16*a* has a lower pressure than the flow field of the wet steam flow s.

As shown in FIG. 2, a slit 22 is formed in a trailing edge side end portion of the hollow portion 12*a* in a width direction of the stator blade 12 and is in communication with the hollow portion 12*a*.

Figure 3:
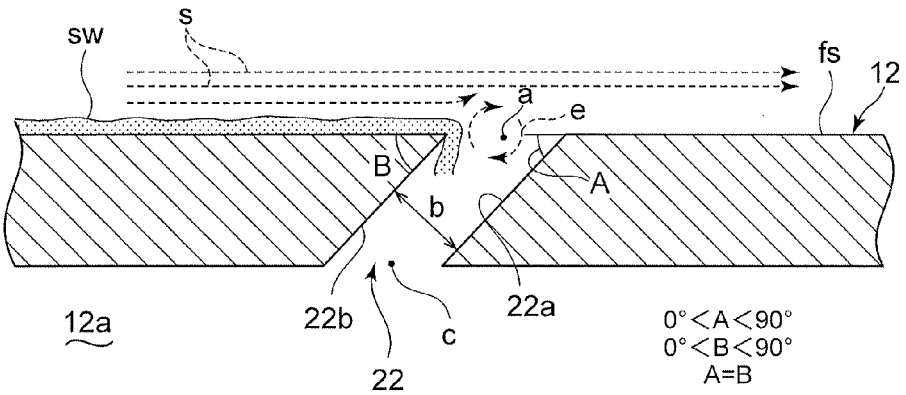
FIG. 3 is an enlarged transverse sectional view of portion X in FIG. 2.

As shown in FIG. 3, the slit 22 has a stator blade trailing edge side wall surface 22*a* and a stator blade leading edge side wall surface 22*b*, each of which has a linear form in a cross sectional view, and which are formed so as to be parallel to each other. Further, the stator blade trailing edge side wall surface 22*a* and the stator blade leading edge side wall surface 22*b* are formed so that each of the inclination angle A of the stator blade trailing edge side wall surface 22*a* to the leading edge side reference plane of the pressure surface fs of the stator blade, and the inclination angle B of the stator blade leading edge side wall surface 22*b* to the leading edge side reference plane of the pressure surface fs of the stator blade is an acute angle (i.e. $0° < A,B < 90°$, A=B or A≠B). From a viewpoint of easiness of processing and strength of the stator blade 12, it is preferred that 20°≤A, B≤70° is satisfied.

Accordingly, each of the inlet opening a and the outlet opening c has a width larger than the slit width b of the slit 22. The slit width d of the slit 22 is usually set to be at least 0.5 mm due to a limitation in processing.

Figure 4:
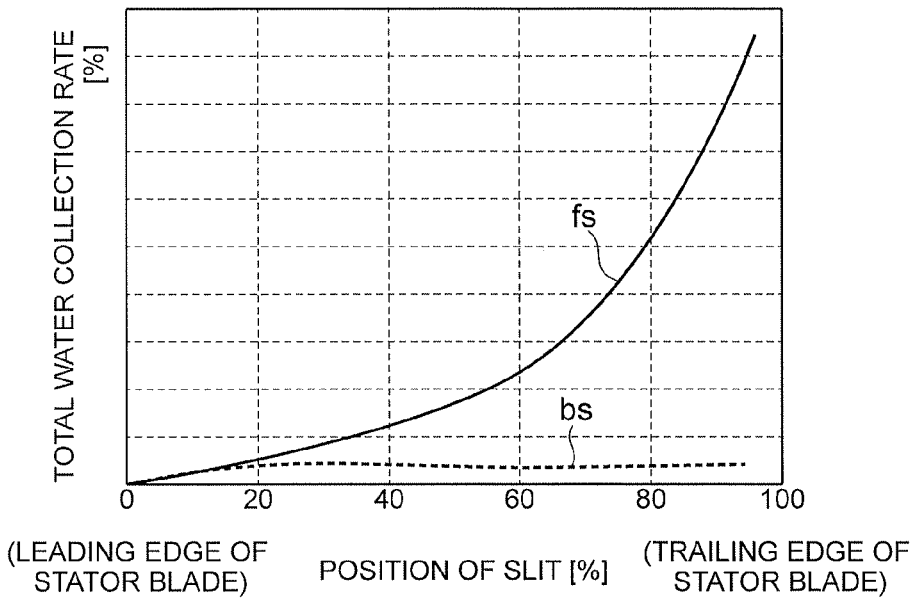
FIG. 4 is a chart showing a total water collection rate on surfaces of the stator blade.

The chart of FIG. 4 shows a total water collection ratio on the pressure surface fs of the stator blade and the suction surface bs of the stator blade. As shown in FIG. 4, the total water collection rate on the suction surface bs of the stator blade does not substantially change in the width direction of the stator blade; and in contrast, the total water collection rate on the pressure surface fs of the stator blade increases sharply as the position becomes closer to the trailing edge. The chart of FIG. 4 shows that it is possible to increase the water removal amount as the inlet opening of the slit 22 is disposed closer to the trailing edge.

With reference to FIG. 3, the wet steam flow s flows from the leading edge side of the stator blade along the pressure surface fs of the stator blade, and the water film flow sw on the pressure surface fs of the stator blade also flows toward the trailing edge of the stator blade with the wet steam flow s. Since the inclination angle B of the stator blade leading edge side wall surface 22*b* is an acute angle, the flow path of the water film flow sw turns at the inlet opening a of the slit at a large degree of at least 90° at the upper end of the stator blade leading edge side wall surface 22*b*. Accordingly, it is possible to efficiently separate the water film flow sw from the wet steam flow s.

The inlet opening a of the slit 22 has a width larger than the slit width b of the slit 22, and the width of the inlet opening a is substantially the same as the width of the outlet opening c, and it is not widen to some extent.

Since the inclination angle B is an acute angle, separation of the wet steam flow s arises at the upper end of the stator blade leading edge side wall surface 22*b*. By this separation, the steam flow s becomes less likely to flow into the slit 22, and a part of the separated steam flow forms a vortex e at the inlet opening a of the slit.

The water film flow sw on the pressure surface fs of the stator blade becomes more likely to flow into the inlet opening a because of the separation of the wet steam flow s at the upper end of the stator blade leading edge side wall surface 22*b*. Further, since the flow path of the water film flow sw turns to the slit 22 at a large angle at the upper end of the stator blade leading edge side wall surface 22*b*, the water film flow sw becomes more likely to be separated from the wet steam flow s.

Further, since the inlet opening a is closed by the caused vortex e, the pressure difference between the flow field of the wet steam flow s and the inside of the slit is likely to arise, and it is possible to introduce the water film flow sw by the pressure difference. Accordingly, it is possible to improve the removal efficiency of the water contained in the wet steam flow s. In addition, the outflow amount of the water film flow sw is increased and the inflow amount of the steam flow into the slit 22 is decreased as compared with the conventional techniques, whereby it is possible to reduce the leakage loss and to suppress reduction in the turbine efficiency.

Further, as shown in FIG. 1, the slit 22 according to this embodiment has an inlet opening a which can be disposed closer to the trailing edge re than the conventional slit 112. Thus it is possible to dispose the inlet opening a at a place where the total water collection rate is high, thereby to improve the water removal efficiency relative to the conventional slit 112.

Figure 5:
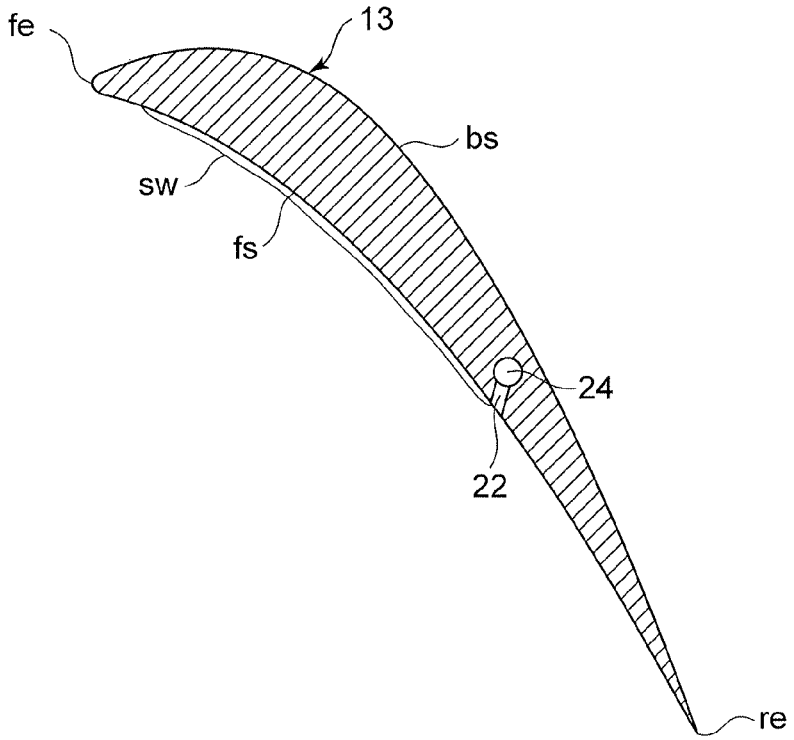
FIG. 5 is a transverse sectional view of a modified example of the first embodiment, applied to a stator blade of which inside is solid.

FIG. 5 is a diagram illustrating a modified embodiment of the above-described first embodiment, which is applied to a stator blade 13 having a solid inside. In the stator blade 13, a water removal flow passage 24 having a smaller volume than the hollow portion 12*a* is formed. In relation to the total water collection rate, the water removal flow passage 24 may be disposed as close to the trailing edge re of the stator blade as possible. However, there is a limitation of the arrangement of the water removal flow passage 24 because of the space inside the stator blade. A slit 22 having the same configuration as in the first embodiment is disposed so as to be communicated with the water removal flow passage 24 at the end portion on the trailing edge side, and the slit 22 has an inlet opening a opening to the pressure surface fs of the stator blade. This modified example also provides the same effect as in the first embodiment.

In the first embodiment or in the above modified example, a suction pump may be connected to the hole 20 of the hollow portion 16*a* via a suction tube, and the suction pump may be configured to reduce pressure in the hollow portion 16*a* or the water removal flow passage 24. It is thereby possible to surely maintain the reduced-pressure state of the hollow portion 16*a* and the water removal flow passage 24.

(Second Embodiment)

Figure 6:
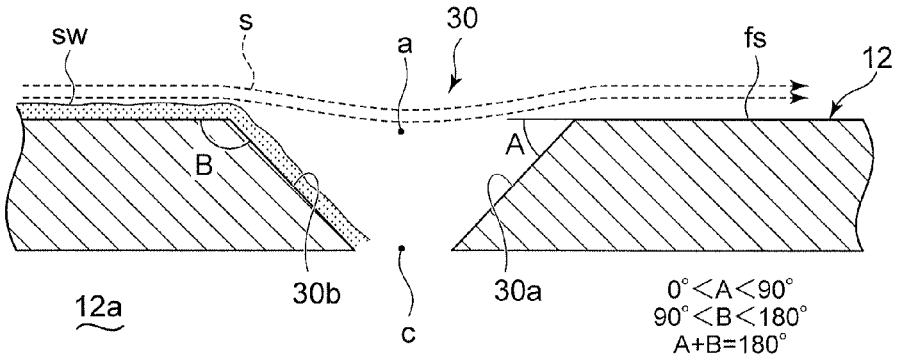
FIG. 6 is a cross sectional view illustrating a shape of a cross section of a slit according to a second embodiment.

A second embodiment of the present invention will now be described with reference to FIG. 6. In this embodiment, the position of the slit 30 on the pressure surface fs of the stator blade and the direction of the slit 30 to the pressure surface fs of the stator blade are the same as the slit 22 according to the first embodiment. The slit 30 has a stator blade trailing edge side wall surface 30*a* and a stator blade leading edge side wall surface 30*b*, each of which has a linear form in a cross sectional view. The inclination angle A of the stator blade trailing edge side wall surface 30*a* to the leading edge side reference plane of the pressure surface fs of the stator blade is an acute angle, and the inclination angle B of the stator blade leading edge side wall surface 30*b* to the leading edge side reference plane of the pressure surface fs of the stator blade is an obtuse angle (0°<A<90°, 90°<B<180°, and A+B=180°).

That is, a cross section of the slit 30 has an inverted trapezoid like shape, having a symmetrical form, which has a wide inlet opening and a small outlet opening c. Except for the slit 30, the water removal device according to this embodiment basically has the same structure as in the first embodiment. From a viewpoint of easiness of processing and strength of the stator blade 12, it is preferred that 20°≤A≤70° and 110°≤B≤160° are satisfied.

By forming the slit 30 to have a cross section having an inverted trapezoid like shape, although the closing effect by the wet steam flow s may be reduced, by employing electric discharging machining using an electrode having an inverted trapezoid like shape, the slit 30 may be formed in one processing step. Further, by employing the above processing method, the slit having the outlet opening c having a small width may be formed. For example, the slit may have an inlet opening having a width of 1.5 mm and an outlet opening having a width of 0.5 mm. Thus, it is possible to reduce efforts and cost for processing and to reduce leakage loss of the steam flow.

(Third Embodiment)

Figure 7:
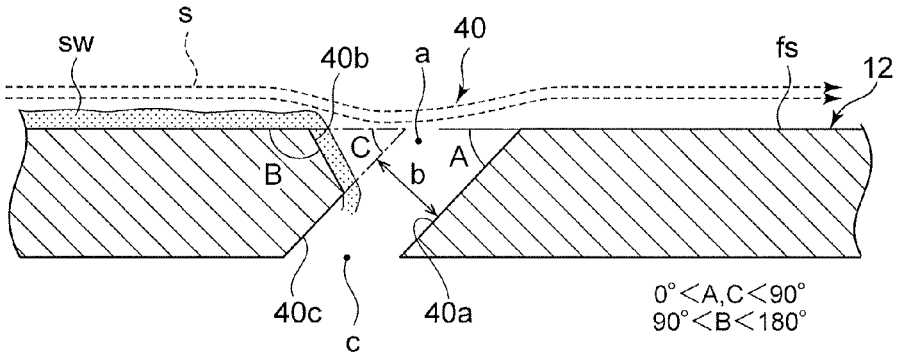
FIG. 7 is a cross sectional view illustrating a shape of a cross section of a slit according to a third embodiment.

A third embodiment of the present invention will now be described with reference to FIG. 7. The position and the direction of the slit 40 according to this embodiment are the same as the slit 22 according to the first embodiment. The slit 40 has a cross section having a cutoff portion at the inlet side region 40*b* of the stator blade leading edge side wall surface.

That is, the slit is formed so that the inclination angle A of the stator blade trailing edge side wall surface 40*a* to the leading edge side reference plane of the pressure surface fs of the stator blade is an acute angle (0°<A<90°), the inclination angle B of the inlet side region 40*b* of the stator blade leading edge side wall surface to the leading edge side reference plane of the pressure surface fs of the stator blade is an obtuse angle (90°<B<180°), and the inclination angle C of the outlet side region 40*c* of the stator blade leading edge side wall surface to the leading edge side reference plane of the pressure surface fs of the stator blade is an acute angle (0°<C<90°). Each of the stator blade trailing edge side wall surface 40*a*, the inlet side region 40*b* and the outlet side region 40*c* of the stator blade leading edge side wall surface has a linear form in a cross sectional view. Except for the slit 40, the water removal device according to this embodiment basically has the same structure as in the first embodiment.

According to this embodiment, the slit 40 has an inlet opening a having a large width relative to the slit 22 according to the first embodiment. Accordingly, although the closing effect at the inlet opening a by the wet steam flow s may be reduced, there is such an advantage that the water film flow sw on the pressure surface fs of the stator blade becomes more likely to flow into the inlet opening a.

(Fourth Embodiment)

Figure 8:
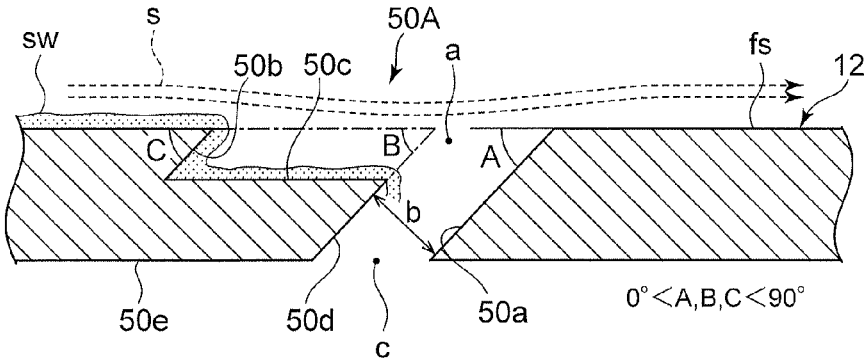
FIG. 8 is a cross sectional view illustrating a shape of a cross section of a slit according to a fourth embodiment.

A fourth embodiment of the present invention will now be described with reference to FIG. 8. The position and the direction of the slit 50A according to this embodiment are the same as the slit 22 according to the first embodiment. In a cross section of the slit 50A, the inclination angle A of the stator blade trailing edge side wall surface 50*a* to the leading edge side reference plane of the pressure surface fs of the stator blade is an acute angle (0°<A<90°), and the stator blade leading edge side wall surface has a stepped surface 50*c* which is disposed between the pressure surface fs of the stator blade and a back surface 50*e* and which is parallel to these surfaces, where the back surface 50*e* is parallel to the pressure surface fs of the stator blade and defines the hollow portion 12*a*.

The inlet side wall surface 50*b* which is continuous to the pressure surface fs of the stator blade and to the stepped surface 50*c*, and the outlet side wall surface 50*d* which is continuous to the stepped surface 50*c* and to the back surface 50*e*, are formed so as to be parallel to the stator blade trailing edge side wall surface 50*a*. That is, each of the inclination angle C of the inlet side wall surface 50*b* to the leading edge side reference plane of the pressure surface fs of the stator blade and the inclination angle B of the outlet side wall surface 50*d* to the leading edge side reference plane of the pressure surface fs of the stator blade is an acute angle (0°<B,C<90°). Each of the wall surfaces constituting the slit 50A has a linear form in a cross sectional view. From a viewpoint of easiness of processing and strength of the stator blade 12, it is preferred that 20°≤A, B and C≤70° is satisfied. Except for the shape of the slit 50A, the water removal device according to this embodiment basically has the same structure as in the first embodiment.

According to this embodiment, by forming the stepped surface 50*c*, the inlet opening is enlarged on the upstream side of the flow direction of the wet steam flow s, and the closing effect by the wet steam s at the inlet opening a may be reduced. However, it is possible to increase the width of the inlet opening a of the slit 50A while introduction of the wet steam flow s is suppressed, without increasing the slit width b of the slit 50A. Accordingly, the water film flow sw on the pressure surface fs of the stator blade becomes more likely to flow into the slit 50A, whereby it is possible to improve the water removal effect. Further, since the inclination angle C of the inlet side wall surface 50*b* is an acute angle, the flow path of the water film flow sw may turn to the slit at a large angel of at least 90° at the upper end of the wall surface 50*b*, whereby it is possible to further improve the separation effect between the wet steam flow s and the water film flow sw.

(Fifth Embodiment)

Figure 9:
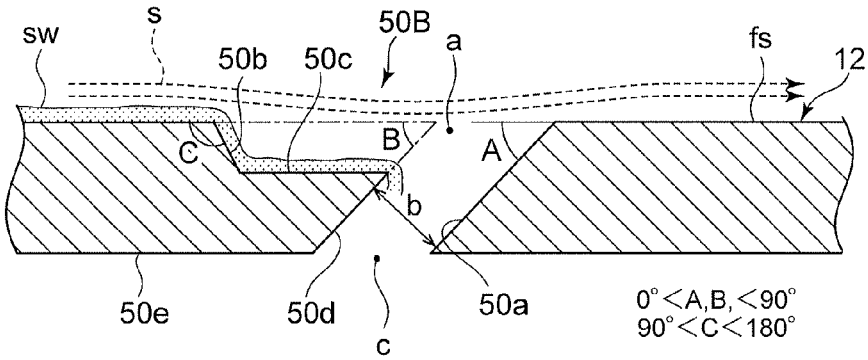
FIG. 9 is a cross sectional view illustrating a shape of a cross section of a slit according to a fifth embodiment.

A fifth embodiment of the present invention will now be described with reference to FIG. 9. In the slit 50B according this embodiment, the inclination angle C of the inlet side wall surface 50*b* (the wall surface continuous to the pressure surface fs of the stator blade and to the stepped surface 50*c*) to the leading edge side reference surface of the pressure surface fs of the stator blade is an obtuse angle (90°<C<180°). Except for this point, the water removal device according to this embodiment basically has the same structure as in the fourth embodiment.

According to this embodiment, since the inclination angle C of the inlet side wall surface 50*b* is an obtuse angle, the water film flow sw becomes more likely to flow to the stepped surface 50*c*, and the inlet side wall surface 50*b* may be formed more easily.

(Sixth Embodiment)

Figure 10:
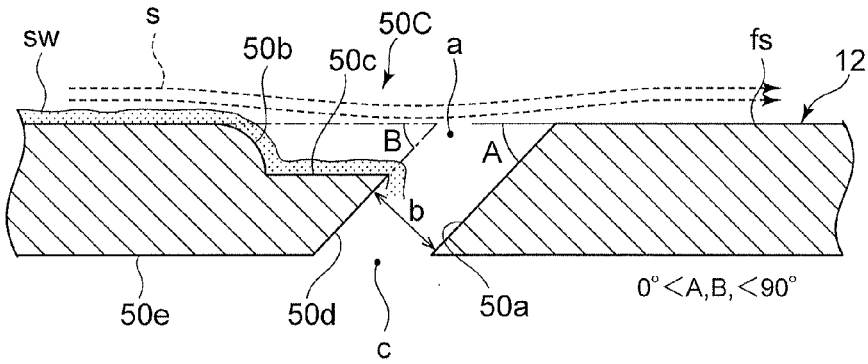
FIG. 10 is a cross sectional view illustrating a shape of a cross section of a slit according to a sixth embodiment.

A sixth embodiment of the present invention will now be described with reference to FIG. 10. The slit 50C according to this embodiment has an inlet side wall surface 50*b* (the wall surface continuous to the pressure surface fs of the stator blade and to the stepped surface 50*c*) having a convex curved surface, in comparison with the fourth embodiment. Except for this point, the water removal device according to this embodiment basically has the same structure as in the fourth embodiment.

According to this embodiment, since the inlet side wall surface 50*b* has a convex curved surface, it is possible to introduce the water film flow sw which has reach the upper end of the inlet side wall surface 50*b* gradually to the stepped surface 50*c*. Accordingly, it is possible to separate the water film flow sw from the wet steam flow s without making the wet steam flow s at the inlet opening a turbulent.

A water removal device according to the present invention may be constituted by combination of two or more of the above-described embodiments, as needed.

EXAMPLES

Figure 11:
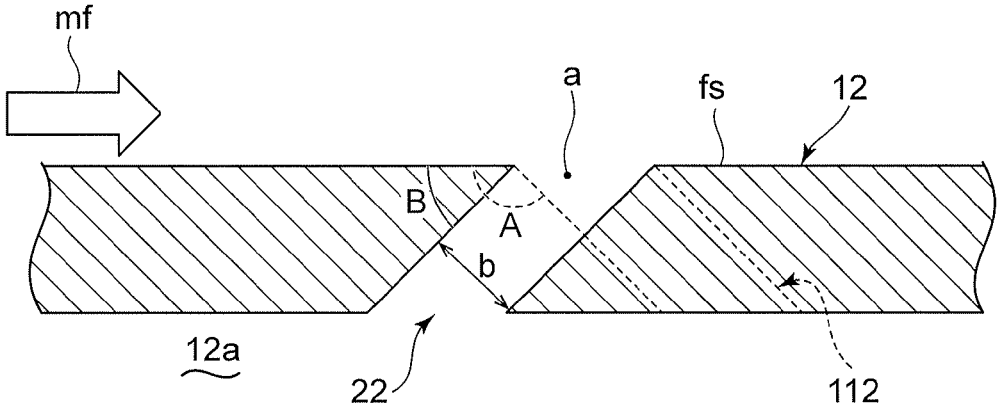
FIG. 11 is a cross sectional view of a conventional slit or a slit according to an embodiment of the present invention, used for an effect evaluation experiment.
Figure 19:
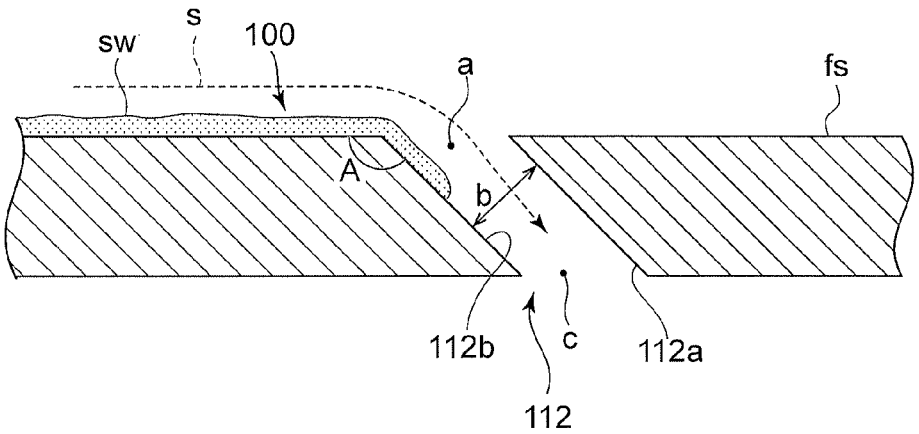
FIG. 19 is an enlarged transverse sectional view of portion Y in FIG. 15.

Now, effect evaluation experiments and the results, which were performed to evaluate the effect provided by the water removal device according to an embodiment of the present invention, will be described with reference to FIG. 11 to FIG. 13. FIG. 11 is a cross sectional view showing a slit according to an embodiment and a conventional slit. As shown in FIG. 11, the slit used in the experiments includes a slit 22 according to the first embodiment as shown in FIG. 3 and a slit 112 according to a conventional technique as shown in FIG. 19. The inclination angle B of the slit 22 is 45°, and the inclination angle A of the slit 112 is 135°. Both of the slits have the same slit width b. The inlet openings a of both of the slits are formed at the same position in the width direction of the stator blade 12.

In the experiments, as the working fluid mf, a two-phase fluid containing air having water added, simulating an actual wet steam flow s, was used. The particle size of the water was made substantially the same as the particle size of the water contained in the wet steam flow s.

Figure 12:
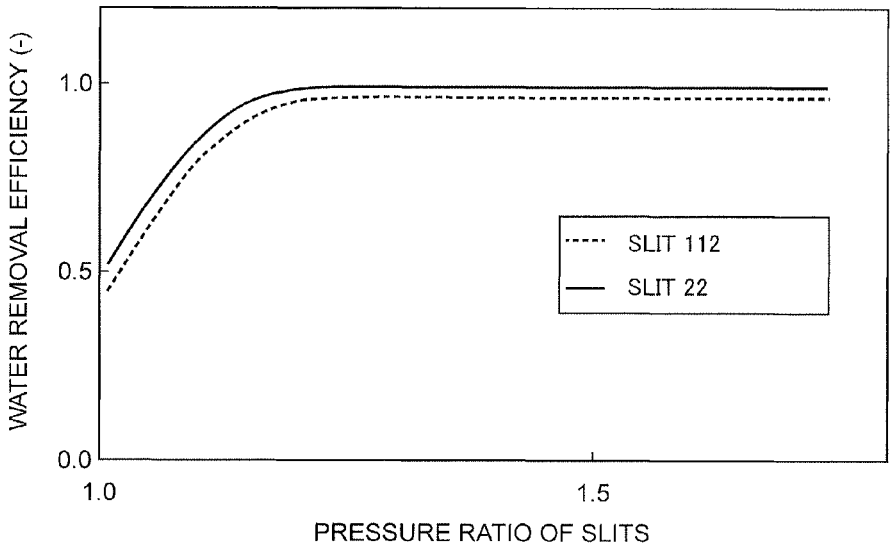
FIG. 12 is a chart showing a test result of the effect evaluation experiment.
Figure 13:
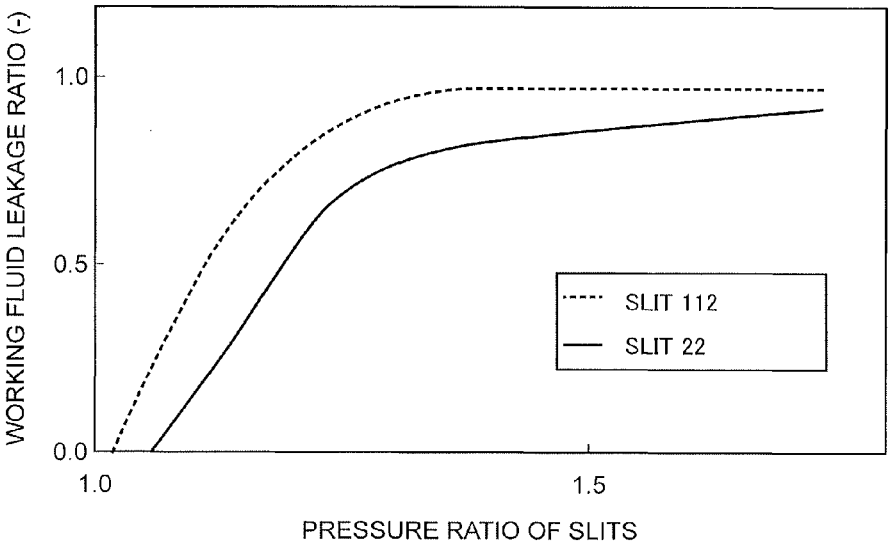
FIG. 13 is a chart showing another test result of the effect evaluation experiment.
Figure 14:
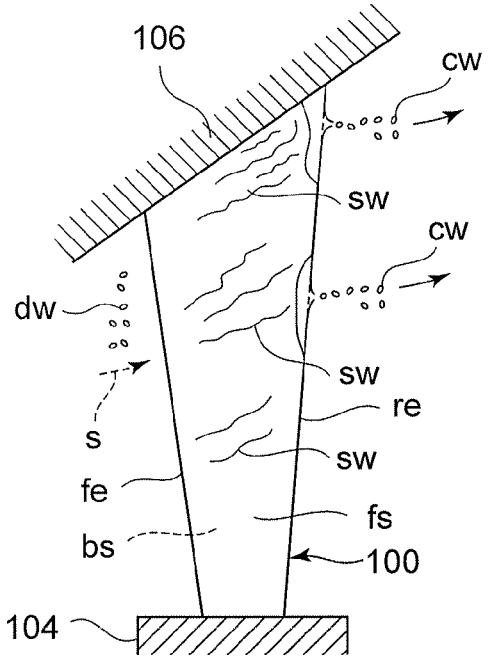
FIG. 14 is an explanatory diagram illustrating a flow field of a wet steam flow in a steam turbine.

The chart of FIG. 12 shows the water removal efficiency of both of the slits, and the chart of FIG. 13 shows the leakage ratio which represents the ratio of the working fluid mg leaked to the hollow portion 12*a* of the stator blade 12. Each of the horizontal axes (pressure ratio of the slits) of the charts of FIG. 12 and FIG. 13 represents the ratio (pressure on the pressure surface fs side of the stator blade)/(pressure in the hollow portion 12*a*).

FIG. 12 and FIG. 13 show that each of the water removal efficiency and the working fluid leakage ratio increases as the slit pressure ratio of the slits increases. In the chart of FIG. 12, the water removal efficiency of the slit 22 is slightly higher than that of slit 112.

The reason for this is, as described above, that with the slit 22, since the flow passage of the flow film flow sw turns to the slit 22 at a large angle at the upper end of the stator blade leading edge side wall surface 22*b*, the water film flow sw becomes likely to be separated from the steam flow s, and since the inlet opening a is closed by the caused vortex e, a pressure difference between the flow field of the wet steam flow s and the slit is likely to occur, and the water film flow sw can be efficiently introduced because of the pressure difference.

In an actual situation, in the stator blade 12, the inlet opening a of the slit 22 can be disposed closer to the trailing edge of the stator blade 12 than the slit 112, the water removal efficiency may be largely improved relative to the slit 112.

Further, since the slit 22 provides a large effect to separate the water film flow sw from the steam flow s at the inlet opening a, the working fluid leakage ratio can be reduced by approximately 20 to 30% as compared to the slit 112, as shown in FIG. 13.

INDUSTRIAL APPLICABILITY

According to the present invention, it is possible to remove water from a wet steam flow at a high efficiency with a stator blade obtained by a simple processing, and it is possible to effectively suppress erosion of the rotor blade.

REFERENCE SIGNS LIST

10 Water removal device
12, 13, 100 Stator blade
12*a*, 100*a* Hollow portion
14, 104 Diaphragm
16, 106 Support ring
16*a*, 106*a* Hollow portion
18, 20, 106*b*, 106*c* Hole
22, 30, 40, 50A, 50B, 50C, 112, 114 Slit
22*a*, 30*a*, 40*a*, 50*a*, 112*a* Stator blade trailing edge side wall surface
22*b*, 30*b*, 112*b* Stator blade leading edge side wall surface
40*b* Inlet side region
40*c* Outlet side region
50*b* Inlet side wall surface
50*c* Stepped surface
50*d* Outlet side wall surface
a Inlet opening
b Slit width
c Outlet opening
24 Water removal flow passage
50*e* Back surface
102 Rotor blade
108 Rotor shaft
110 Disk rotor
116 Slit groove
A, B, C Inclination angle
U Circumferential velocity
Vs, Vcw Absolute velocity
Ws, Wcw Relative velocity
bs Suction surface of the stator blade
cw Coarse water drop
dw Small water drop
fe Leading edge of the stator blade
fs Pressure surface of the stator blade
mf Working fluid
re Trailing edge of the stator blade
s Wet steam flow
sw Water film flow

The invention claimed is:

1. A water removal device for a steam turbine for removing water on a pressure surface of a stator blade, comprising:

a water removal flow passage formed in a hollow portion of the stator blade; and a slit extending in a direction intersecting with a steam flow, opening to the pressure surface of the stator blade and being communicated with a trailing edge side end portion of the water removal flow passage, wherein the slit has a stator blade trailing edge side wall surface being at an acute angle to a leading edge side reference plane of the pressure surface of the stator blade, wherein the slit has a stator blade leading edge side wall surface including:

a stepped surface which is disposed between the pressure surface of the stator blade and a back surface and which is parallel to the pressure surface of the stator blade, the back surface being parallel to the pressure surface of the stator blade and defining the hollow portion;

an inlet side wall surface which is continuous to the pressure surface of the stator blade and to the stepped surface; and an outlet side wall surface which is continuous to the stepped surface and the back surface, and wherein the outlet side wall surface is at an acute angle to the leading edge side reference plane of the pressure surface of the stator blade.

2. The water removal device for a steam turbine according to claim 1, wherein the inlet side wall surface of the stator blade leading edge side wall surface of the slit is at an obtuse angle to the leading edge side reference plane of the pressure surface of the stator blade.

3. The water removal device for a steam turbine according to claim 1, wherein the inlet side wall surface continuous to the pressure surface of the stator blade and to the stepped surface is provided so as to be at an acute angle to the leading edge side reference plane of the pressure surface of the stator blade.

4. The water removal device for a steam turbine according to claim 1, wherein the inlet side wall surface continuous to the pressure surface of the stator blade and to the stepped surface is provided so as to be at an obtuse angle to the leading edge side reference plane of the pressure surface of the stator blade.

5. The water removal device for a steam turbine according to claim 1, wherein the inlet side wall surface continuous to the pressure surface of the stator blade and to the stepped surface includes a convex curved surface.

* * * * *